United States Patent [19]

Geringer et al.

[11] Patent Number: 5,033,779

[45] Date of Patent: Jul. 23, 1991

[54] ELECTROMAGNETIC DOOR LOCK DEVICE

[76] Inventors: Arthur Geringer, 5029 E. Jacobs Ct., Agoura, Calif. 91301; Richard Geringer, 2663 Riata Ct., Camarillo, Calif. 93010; David Geringer, 28364 Balkin, Agoura, Calif. 91301

[21] Appl. No.: 516,583

[22] Filed: Apr. 30, 1990

[51] Int. Cl.[5] ..... E05C 17/56

[52] U.S. Cl. ..... 292/251.500; 292/DIG. 72

[58] Field of Search ..... 292/251.5, 144, DIG. 72, 292/DIG. 4, 73, DIG. 38

[56] References Cited

U.S. PATENT DOCUMENTS

| | | | |
|---|---|---|---|
| 545,277 | 8/1895 | Feinberg | 292/DIG. 72 X |
| 3,492,037 | 1/1970 | Hutchinson | 292/251.5 |
| 4,696,500 | 9/1987 | Zunkel | 292/251.5 |
| 4,826,223 | 5/1989 | Geringer et al. | 292/144 X |

FOREIGN PATENT DOCUMENTS

| | | | |
|---|---|---|---|
| 804 | 1/1900 | Austria | 292/72 |

*Primary Examiner*—Richard E. Moore

*Attorney, Agent, or Firm*—John J. Posta, Jr.

[57] ABSTRACT

An improvement is provided in an electromagnetic door lock device. The device itself includes an electromagnet in a housing adapted to be connected to the top of a door frame and depend from the underside thereof above a door in the frame. The device also includes an armature block connected to the top of the door in a position near the electromagnet. The armature moves between a down inoperative position away from the electromagnet, facilitated by gravity, when the electromagnet is deenergized and an up extended operative position against the underside of the electromagnet housing when the electromagnet is energized. A locking plate connected to the housing has a tab which depends therefrom and abuts the armature when the latter is in the up position to lock the door closed in the door frame. The improvement prevents slow separation of the armature and tab and hesitant unlocking of the door when the electromagnet is deenergized. It is a separation accelerator which may be one or more flexible resilient elastomeric plugs, springs, ball and spring arrays, plug and spring arrays or the like in pockets in the top surface of the armature and projecting upwardly therefrom, but readily compressible by the electromagnet housing. When the electromagnet is deenergized, the armature is sprung away therefrom by the accelerator and also by gravity for improved operation. When the electromagnet is energized, the accelerator acts as a cushioning device to lower the amount of noise generated by the mating of the armature to the electromagnet.

16 Claims, 1 Drawing Sheet

ELECTROMAGNETIC DOOR LOCK DEVICE

BACKGROUND OF THE INVENTION

1. FIELD OF THE INVENTION

The present invention generally relates to electromagnet door lock devices and more particularly to an improved form of said device which unlocks more rapidly and positively.

2. PRIOR ART

There are various types of electromagnetic door locks, most of which are complicated and expensive to make, install and service and many of which do not perform efficiently or durably. One particular lock is that shown in U.S. Pat. No. 4,487,439. The device utilizes a specially configured electromagnet having a central locking tab which must be perfectly aligned with a central dimple in an armature in order for the device to function properly. Such an electromagnetic device is expensive to make and difficult to properly install. Considerable shear stress is applied to electromagnet housing so that it can rupture and damage the expensive electromagnet.

An improved electromagnet door lock overcoming the foregoing deficiencies is set forth in U.S. Pat. No. 4,826,223, the inventor of which is the present applicant. Although the door lock described and claimed therein works well, in some instances, there is some hesitation and delay in the automatic gravitationally operated door unlocking function when the electromagnet is deenergized. This is because the locking tabs can closely abut the armature, so that the armature cannot freely slide away thereform, urged by gravity.

Additionally, the prior art provides armatures which are rapidly attracted to the electromagnet causing undue noise, rattling and clattering, which is distracting and unwanted noise. This noise is exacerbated by having the armature attracted to the electromagnet at other than a flat, horizontal presentation.

Accordingly, there remains a need for an improvement which will accelerate the rate of separation of the door armature from the electromagnet housing and locking tabs of the device in order to allow the door to be opened more rapidly.

SUMMARY OF THE INVENTION

The improvement of the present invention comprises an armature separation accelerator which satisfies all the foregoing needs. The separation accelerator may be one or more flexible, resilient elastomeric plugs or rods, or can be spring, ball and spring arrays, plugs and spring arrays and the like disposed in spaced pockets in the top surface of the armature in an electromagnetic door lock device, and projecting upwardly therefrom. The accelerator is compressible by the underside of the electromagnet housing disposed on the top edge of a doorway. The armature is carried on the top edge of the door disposed in the doorway. The locking device includes a locking plate with depending locking tab(s) which abuts the armature and holds the door closed when the armature is magnetically attracted up to the energized electromagnets in the housing. When the electromagnet is deenergized, the armature drops away from the housing by gravity and with the spring action assistance of the separation accelerator so as to rapidly clear the bottom edge of the locking tab(s), thus allowing the door to be opened instantly. When the armature mates with the electromagnet, noise is reduced due to the cushioning effect of elastomeric plugs, etc.

Various other features of the present invention are set forth in the following detailed description and accompanying drawings.

DRAWINGS

DETAILED DESCRIPTION

FIGS. 1–4

Figure 1:
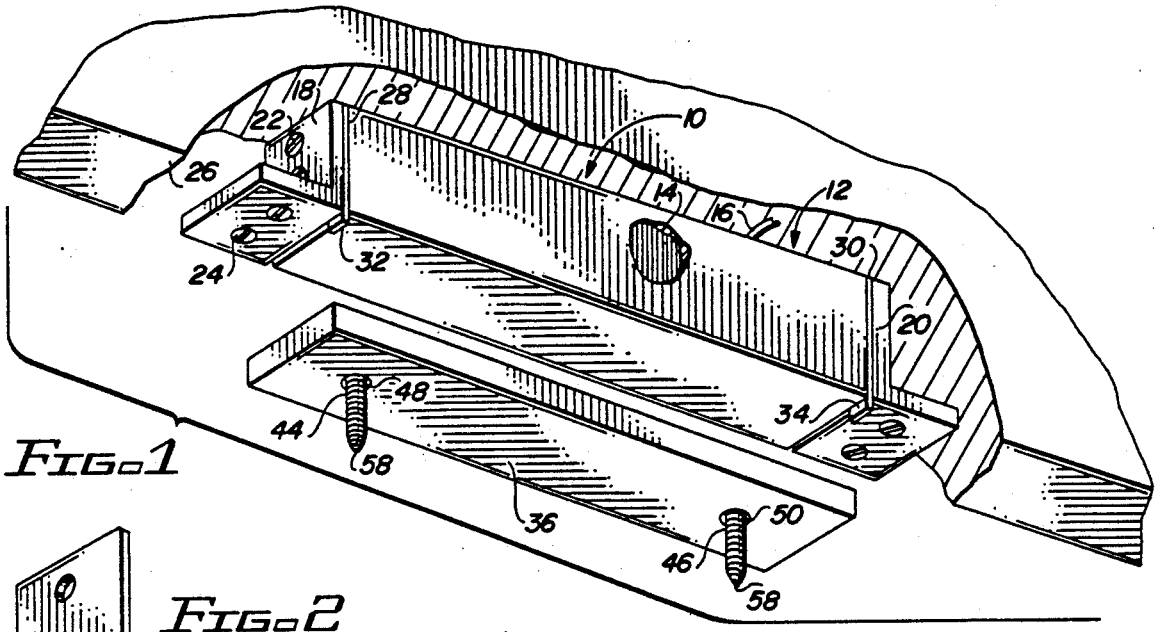
FIG. 1 is a bottom schematic perspective view of the improvement of the present invention in an electromagnetic door locking device, shown with the armature spaced below the electromagnet housing, while the latter is secured to the top of a doorway.

Now referring more particularly to the accompanying drawings, a first preferred embodiment of the improvement in an electromagnetic door locking device is schematically depicted. Thus, device 10 is shown which comprises a generally rectangular housing 12 of metal containing an electromagnet 14 connected to a remote electrical power source (not shown) by a conduit 16 through housing 12. A pair of L-shaped brackets 18 & 20 are secured, as by screws 22, to opposite ends of housing 12 and releasably secure housing 12, by screws 24, to the underside of a door frame 26.

Device 10 also includes a pair of flat locking plates 28 and 30 mounted between brackets 18 & 20, respectively, and the adjacent ends of housing 12, and bearing tabs 32 & 34 depending from the rear edges thereof.

Figure 2:
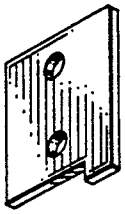
FIG. 2 is a schematic side perspective view of the locking plate,, of the door locking device.

Device 10 also includes an armature 36 in the form of an elongated rectangular metal plate magnetically attracted to electromagnet 14 when the latter is energized. Armature 36 is shown in FIG. 2 mounted on the top surface 38 of a door 40 disposed in opening 42 defined by frame 26 and hinged to swing to one side of frame 26.

A spaced pair of screws 44 and 46 are disposed in unthreaded openings 48 & 50, respectively, in armature 36. Openings 48 & 50 have expanded upper portions 52 to freely accommodate the expanded heads 54 of screws 44 & 46. Threaded openings 56 in door 40 adjustably receive the shanks 58 of screws 44 & 46, so that the spacing and free play between armature 36 and top surface 38 of door 40 can be adjusted by adjusting the height of screws 44 & 46 in door 40. Thus, the extent that armature 36 can move up toward housing 12 when magnetically attracted to electromagnet 14 can be readily adjusted by screws 44 & 46.

When door 40 is closed in frame 26 and electromagnet 14 is energized, armature 36 moves up toward housing 12 forward of and abutting tabs 32 and 34 so that the door cannot be opened. Tabs 32 & 34 thereby lock door 40 in place. This condition continues so long as electromagnet 14 is energized. When it is deenergized, armature 36 drops by gravity away from housing 12 to the resting position shown on the top surface 38 of door 40 in FIG. 3. This clears armature 36 below tabs 32 and 34 so that door 40 can be opened. Because this action is not always crisp and immediate, the improvement of the present invention has been provided as a remedy.

Figure 3:
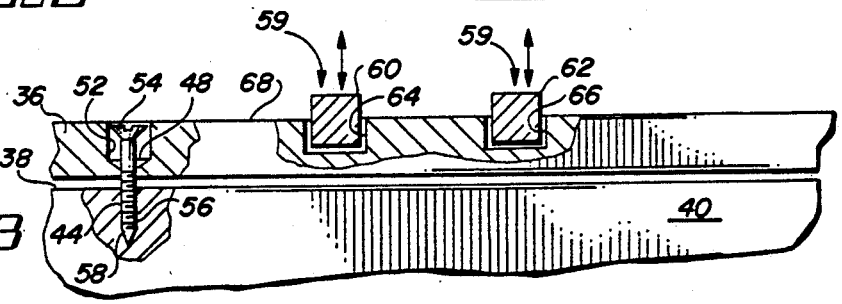
FIG. 3 is an enlarged, fragmentary schematic side elevation, partly broken away and partly in section, of the armature of the device of FIG. 1, bearing the novel separation of the invention, the armature being connected to the top surface of a door.
Figure 4:
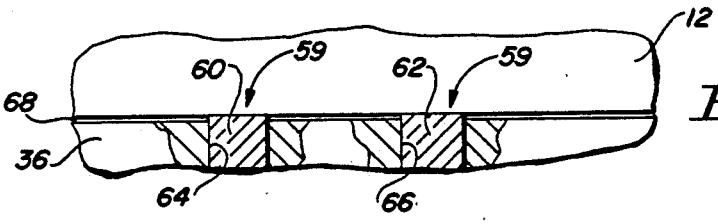
FIG. 4 is a further enlarged, fragmentary, schematic side elevation of a first preferred embodiment of the separation accelerator of the invention, broken away and partly in section, shown compressed against the underside of the electromagnet housing of the device of FIG. 1.

The improvement comprises a separation accelerator 59 on the armature which increases the speed of separation of armature 36 from housing 12 when electromagnet 14 is deenergized. This separator accelerator 59, as shown in FIGS. 3 & 4, comprises a spaced pair of resilient, flexible, compressible elastomeric plugs 60 & 62 of rubber or plastic seated in pockets 64 & 66, respectively, in the top surface 68 of armature 36 and protruding therefrom towards housing 12. When electromagnet 14 is energized, armature 36 travels up to the underside of housing 12 and plugs 60 & 62 are compressed against that underside. When electromagnet 14 is deenergized, armature 36 drops away by gravity from housing 12, aided by the spring action of compressed plugs 60 & 62, for instant return to the resting position of FIG. 3. This eliminates any delay in being able to open door 40, due to frictional resistance between tabs 32 & 34 and the adjacent surfaces of armature 36. Plugs 60 & 62 overcome this frictional resistance and kick armature 36 down and away from housing 12 and tabs 32 & 34.

It will be understood that plugs 60 & 62 can be of any suitable size, shape and composition and can be seated loosely or tightly in pockets 64 & 66, while still providing the present improvement.

FIG. 5

Figure 5:
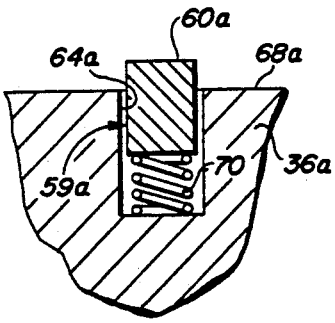
FIG. 5 is an enlarged, fragmentary, schematic side elevation, partly broken away and partly in section, of a second preferred embodiment of the improved separation accelerator of the invention.

A modified form of the separation accelerator of the present invention is schematically depicted in FIG. 5. Thus, separation accelerator **59*a* is shown. Components thereof similar to those of accelerator 59** bear the same numerals but are succeeded by the letter "a".

Accelerator **59*a* can be directly substituted for accelerator 59 in device 10, and comprise one or more flexible, resilient, compressible elastomeric plugs 60*a*, each disposed in a pocket 64*a* in the top surface 68*a* of armature 36*a*. Each plug 60*a* has a coiled spring 70 disposed between its lower end and the bottom of pocket 64*a* to facilitate and further enhance the compression and spring action of accelerator 59*a***.

FIG. 6

Figure 6:
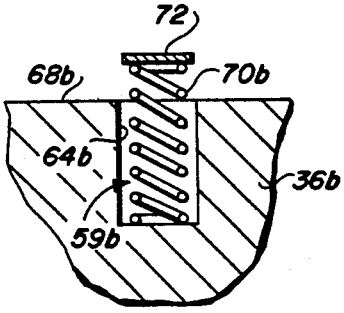
FIG. 6 is an enlarged, fragmentary, schematic side elevation, partly broken away and partly in section, of a third preferred embodiment of the improved separation accelerator of the invention; and, FIG. 7 is an enlarged, fragmentary, schematic side elevation, partly broken away and partly in section, of a fourth preferred embodiment of the improved separation accelerator of the invention.

A third preferred form of the separation accelerator of the present invention is schematically depicted in FIG. 6. Thus, separator **59*b* is shown. Components thereof similar to those of accelerator 59 or 59*a* bear the same numerals but are succeeded by the letter "b". Accelerator 59*b* comprises one or more coiled springs 70 *b*, one in each pocket 64*b* in the top surface 68*b* of armature 36*b*, with or without a pusher plate 72 on the top thereof, and having the same spring recoil action as do plugs 64, 66 and 64*a***.

FIG. 7

Figure 7:
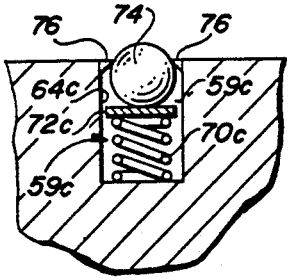

A fourth preferred embodiment of the separation accelerator of the present invention is schematically depicted in FIG. 7. Thus, separator **59*c* is shown. Components thereof similar to those of accelerator 59, 59*a* or 59*b* bear the same numerals but are succeeded by the letter "c". Accelerator 59*c* comprises one or more coiled springs 70*c*, one per each pocket 64*c*, with a pusher plate 72*c* on top of spring 70*c* and an inflexible ball 74 of ceramic, metal, plastic or the like on top of plate 72. The upper edges 76 of pocket 64*c* are configured inwardly to form a rim 76 which restricts the opening of pocket 64*c* so as to prevent ball 74 from fully ejecting upwardly out of pocket 64*c*. Accelerator 59*c* has the same advantages as accelerators 59, 59*a* and 59*b***.

It should be appreciated that in all the above embodiments, noise is reduced because the components used to accelerate separation of the armature from the electromagnet when the electromagnet is deenergized also serve to cushion the mating of the armature to the electromagnet when the latter is energized, thereby reducing noise. The clattering due to the less than level presentation of the top of the armature to the bottom of the electromagnet is reduced by having a plurality of cushioning devices at different locations on the face of the armature.

Various other modifications, changes, alterations and additions can be made in the improved device of the present invention, particularly the separation accelerator thereof, its components and parameters. All such modifications, changes, alterations and additions as are within the scope of the appended claims form part of the present invention.

What is claimed is:

1. In an electromagnetic door lock device having an electromagnet in a housing secured to the underside of the top portion of a door frame, an armature secured to the top of a door in said frame in a position which is opposite said electromagnet when said door is in a closed position magnetically and attracted to the energized electromagnet means for securing said armature to said door for movement between an upwardly extended operative position abutting the underside of said electromagnet housing when the electromagnet is energized and a down gravitationally retracted inoperative position when said electromagnet is deenergized, and a locking plate with tab connected to said housing and depending therefrom so as to abut said armature only when the latter is in the upwardly extended operative position so as to lock the door closed, the improvement which comprises a separation accelerator, including biasing means disposed between said electromagnet and said armature which provides a vertical force tending to separate said electromagnet and said armature, and facilitates rapid gravitational separation of said armature from said electromagnet when said electromagnet is deenergized to be aligned with the forces of gravity on said armature and thereby aid in overcoming any residual magnetic holding force attracting said armature to said electromagnet.

2. The improvement of claim 1 wherein said separation accelerator comprises at least one flexible, resilient, compressible component disposed in and extending upwardly out of the top surface of said armature for depressible contact with said housing when said electromagnet is energized.

3. The improvement of claim 2 wherein said compressible component comprises a resilient elastomeric plug of at least one of rubber and rubber-like plastic.

4. The improvement of claim 3 wherein said plug is backed by a compressible spring in a pocket in said top surface of said armature.

5. The improvement of claim 2 wherein said compressible component comprises a coiled spring seated in a pocket in said top surface of said armature.

6. The improvement of claim 2 wherein said compressible component is a ball seated on a compressible spring in a pocket in said top surface of said armature and wherein said ball is held by retaining means from fully ejecting from said pocket.

7. The improvement of claim 6 wherein said ball is one of (a) flexible, resilient and compressible and (b) hard and inflexible.

8. An electromagnetic assembly, comprising:

(a) an electromagnet, (b) means to energize and deenergize said electromagnet, (c) an armature positioned below said electromagnet so as to be attracted thereto when said electromagnet is energized, and to have a tendency to separate from said electromagnet due to the force of gravity when said electromagnet is deenergized, (d) separation accelerator means which store separation energy when said armature is attracted to said electromagnet, (e) said separator accelerator means including biasing means which provides a vertical force tending to separate said electromagnet and said armature, (f) whereby said separation accelerator develops vertical separation forces which are aligned with the force of gravity, and (g) whereby said stored separation energy is utilized to separate the armature from said electromagnet when said electromagnet is deenergized.

9. The electromagnetic assembly of claim 8 wherein said separation accelerator comprises at least one flexible, resilient, compressible component disposed in and extending upwardly out of the top surface of said armature for depressible contact with said housing when said electromagnet is energized.

10. The electromagnetic assembly of claim 9 wherein said compressible component comprises a resilient elastomeric plug of at least one of rubber and rubber-like plastic.

11. An electromagnetic assembly, comprising:

(a) an electromagnet, (b) means to energize and deenergize said electromagnet, (c) an armature positioned relative to said electromagnet so as to be attracted thereto when said electromagnet is energized, and (d) separation accelerator means which store separation energy when said armature is attracted to said electromagnet, (e) whereby said stored separation energy is utilized to separate the armature from said electromagnet when said electromagnet is deenergized.

(f) wherein said separation accelerator comprises at least one flexible, resilient, compressible component disposed in and extending upwardly out of the top surface of said armature for depressible contact with said housing when said electromagnet is energized.

(g) wherein said compressible component comprises a resilient elastomeric plug of at least one of rubber and rubber-like plastic, and (h) wherein said plug is backed by a compressible spring in a pocket in said top surface of said armature.

12. The electromagnetic assembly of claim 9 wherein said compressible component comprises a coiled spring seated in a pocket in said top surface of said armature.

13. The electromagnetic assembly of claim 9 wherein said compressible component is a ball seated on a compressible spring in a pocket in said top surface of said armature and wherein said ball is held by retaining means from fully ejecting from said pocket.

14. The electromagnetic assembly of claim 13 wherein said ball is one of a (a) flexible, resilient and compressible and (b) hard and inflexible.

15. The electromagnet assembly of claim 8 wherein said separation accelerator means includes cushioning means to decrease the noise generated when the armature is attracted to the electromagnet.

16. The electromagnet assembly of claim 8 wherein said cushioning means are disposed at multiple locations upon the face of the magnet.

* * * * *